US009993859B2

(12) United States Patent
Schneider et al.

(10) Patent No.: US 9,993,859 B2
(45) Date of Patent: Jun. 12, 2018

(54) SHEET METAL BLANK

(71) Applicant: Muhr und Bender KG, Attendorn (DE)

(72) Inventors: Christoph Schneider, Lennestadt-Elspe (DE); Harald Eichner, Hennef (DE); Joachim Ivo, Lennestadt (DE)

(73) Assignee: Muhr und Bender KG, Attendorn (DE)

( * ) Notice: Subject to any disclaimer, the term of this patent is extended or adjusted under 35 U.S.C. 154(b) by 0 days. days.

(21) Appl. No.: 15/376,946

(22) Filed: Dec. 13, 2016

(65) Prior Publication Data

US 2017/0173651 A1 Jun. 22, 2017

(30) Foreign Application Priority Data

Dec. 18, 2015 (EP) ..... 15201051

(51) Int. Cl.
*B21B 37/16* (2006.01)
*B21B 38/04* (2006.01)
(Continued)

(52) U.S. Cl.
CPC ..... *B21B 37/165* (2013.01); *B21B 38/04* (2013.01); *B21D 28/06* (2013.01);
(Continued)

(58) Field of Classification Search
CPC ... B21B 37/165; B21B 38/04; B21B 15/0007; B21B 37/26; B21B 2261/05;
(Continued)

(56) References Cited

U.S. PATENT DOCUMENTS 7,181,948 B2 * 2/2007 Arns ..... C21D 1/673 72/185
2009/0282884 A1 * 11/2009 Pawelski ..... B21B 37/44 72/201
2015/0190883 A1 * 7/2015 Erlwein ..... B23K 26/0846 219/121.72

FOREIGN PATENT DOCUMENTS

DE 10 2011 001 320 A1 10/2012
DE 10 2012 014 258 A1 1/2014
(Continued)

OTHER PUBLICATIONS

European Search Report for EP 15201051.8-1702 dated Jun. 1, 2016 (5 pages).

*Primary Examiner* — Shelley Self
*Assistant Examiner* — Mohammad Yusuf
(74) *Attorney, Agent, or Firm* — Bejin Bieneman PLC

(57) ABSTRACT

A process includes flexible rolling of a strip made of a metallic material, wherein a thickness profile with different sheet thicknesses along the length of the strip is produced such that successive regions of the flexibly rolled strip each correspond to a target thickness profile of a sheet metal blank to be cut out of same; determining a measured thickness profile of a plurality of successive regions of the strip; calculating a target position in the strip for a sheet metal blank to be cut out of the strip depending on the generated measured thickness profile of at least two successive regions of the strip; cutting the flexibly rolled strip by at least one cutting device along the target position for producing the sheet meal blank. A plant is further provided for producing a sheet metal blank.

11 Claims, 3 Drawing Sheets

(51) Int. Cl.
*B21D 28/06* (2006.01)
*B21B 15/00* (2006.01)
*B21B 37/26* (2006.01)

(52) U.S. Cl.
CPC ..... *B21B 15/0007* (2013.01); *B21B 37/26* (2013.01); *B21B 2205/02* (2013.01)

(58) Field of Classification Search
CPC ..... B21B 37/24; B21B 2204/02; B21B 2015/0014; B21B 2015/0021; B21B 2205/02; B21B 37/70; B23K 26/0846
USPC ..... 72/203, 9.2, 9.4, 11.8
See application file for complete search history.

(56) References Cited

FOREIGN PATENT DOCUMENTS

| | | | |
|---|---|---|---|
| DE | 10 2012 110 972 | B3 | 3/2014 |
| EP | 2420344 | B1 | 5/2013 |
| EP | 2949787 | A2 | 12/2015 |
| WO | 2010085486 | A1 | 7/2010 |

* cited by examiner

SHEET METAL BLANK

CROSS-REFERENCE TO RELATED APPLICATIONS

This application claims priority to European Application No. 15201051.8 filed on Dec. 18, 2015, which application is hereby incorporated herein by reference in its entirety.

BACKGROUND

From DE 10 2012 110 972 B3 a process of producing a product out of flexibly rolled strip material is known. The flexibly rolled strip material is subsequently electrolytically coated and heat-treated. Out of said flexibly rolled strip material blanks are produced by being mechanically cut or laser-cut. The blanks produced in this way can subsequently be turned into a formed part by a forming process, which formed part can be designed to become a structural component for a motor vehicle.

DE 10 2012 014 258 A1 proposes a process of producing a component out of steel with a reduced edge crack sensitivity. The component is produced by forming a sheet metal blank out of steel in the case of which the sheet metal blank is first cut out of a strip material and subsequently formed into a component. Cutting the blank takes place at a temperature above room temperature and below the Ac1 transformation temperature. The blank can be produced so as to comprise different thicknesses.

From WO 2010/085486 A1 a process and a plant for laser cutting sheet metal blanks out of steel strip is known.

EP 2 420 344 B1 proposes a process of producing a contour cut out of a sheet strip. In respect of its width, the sheet metal strip is divided into at least three working strips to be worked, with each such strip being associated with a laser cutting device. The working area of the first laser cutting device adjoins the working area of the second laser cutting device upstream or downstream. The laser cutting devices are controlled such that a first portion of the contour cut is produced by the laser cutting device operating upstream and a second portion, to finish the contour cut, is produced by the laser cutting device operating downstream.

SUMMARY

The present disclosure relates to a process and a device for producing sheet metal blanks with different sheet thicknesses. Proposed herein is a process of producing sheet metal blanks with different sheet thicknesses, which process ensures a high degree of process stability and a high degree of production accuracy of the sheet blanks to be produced, respectively a low reject rate. Further proposed is a suitable plant for producing sheet metal blanks with high process stability and with a high degree of accuracy.

A process of producing a sheet metal blank comprises: flexible rolling of a strip made of a metal-based material, wherein a thickness profile with different sheet thicknesses along the length of the strip is produced such that successive regions of the flexibly rolled strip material each correspond to a target thickness profile of a sheet metal blank to be cut out of the same; generating a measured thickness profile of a plurality of regions positioned one behind the other; calculating a target position in the strip for a sheet metal blank to be cut out of the strip depending on the generated measured thickness profile of at least two regions of the strip material positioned one behind the other; cutting the flexibly rolled strip by at least one cutting device along the target position for producing for producing the sheet metal blank.

An advantage is that it is possible to precisely associate the target contour position for the sheet metal blank to be cut out of the strip material with the measured sheet thickness profile of the strip material. In this way a high degree of production accuracy of the sheet metal blanks to be produced is achieved, e.g., the percentage of non-usable rejects resulting from production inaccuracies is reduced. As the strip material is measured prior to carrying out the cutting process, any regions of the blank whose thickness does not correspond to the geometric specifications can, as the case may be, remain unmachined, i.e., uncut. This results in a particularly high process efficiency because there will be no unnecessary rejects. The target position can also be referred to as nominal or required position.

The starting material used for flexible rolling is a strip material made of metal, i.e., a metallic strip material. This includes in particular materials which contain at least one metallic element and/or an alloy of metallic elements. In the case of industrial production, frequently use is made of a strip material including steel and/or a steel alloy, but strip material including other metals such as aluminium and/or aluminium alloys can also be used. It is possible to use hot strip or cold strip, with these terms being used in the sense of technical terminology referring to different strip widths, i.e., band widths. Hot strip is meant to refer to a rolled steel finished product (steel strip) which is produced by rolling after having previously been heated. Cold strip is meant to be a cold-rolled steel strip (flat steel). The term cold-rolled refers to a flat steel whose final thinning is effected by rolling without prior heating.

In the course of flexible rolling, the strip material with a substantially uniform sheet thickness is rolled out by changing the rolling gap to obtain a strip material with a variable sheet thickness along its length. Thereby, the strip material is rolled in such a way that strip thickness profiles produced region by region correspond to a respective target thickness profile of a blank to be cut from said strip material. This means in particular that a thickness profile produced in a region by flexible rolling at least substantially corresponds to the target thickness profile of the blank to be cut out of same, i.e., by taking into account production and position tolerances. Within the context of the present disclosure, a strip material region is meant to be a geometrically definable part of the strip material out of which an associated blank is cut. The individual regions are arranged one behind the other in the strip material. More particularly, it is proposed that the individual regions of the strip material each contain several portions with different thicknesses. Said portions with different thicknesses produced by flexible rolling extend transversely to the longitudinal direction, i.e., the rolling direction of the strip material. After having been flexibly rolled, the strip material can easily be wound to a coil and thus transported to a different processing area, or it can undergo further processes there and then.

Determining the thickness profile is carried out, in particular, on the basis of thickness measurements along the length of the strip material. A measured length position, e.g., path position, of the strip material is associated with the respective thickness position, which two form a pair of positions. Measurements can be made with a thickness sensor and a path sensor. Measuring the thickness along the length of the strip material can be carried out incrementally, i.e. in steps, or continuously. In the case of incremental measurements, several positions are measured in the longitudinal direction per sheet metal blank to be cut out. The measured thickness profile is then generated on the basis of the measured thickness values and the associated position values. A particularly high degree of process stability and accurate production are ensured by continuously recording the thickness along the length of the strip material. Each length position of the strip material is continuously associated with a respective thickness position, so that per measured strip region there is available a complete measured thickness profile along the length. This measured thickness profile can then be mathematically compared with the target thickness profile of the sheet metal blank to be cut out, so that the position of the cut to be applied can be individually adapted to the geometric conditions. The positioning and synchronising of the contour position of the blanks to be cut out of the strip relative to the given sheet thickness profile can be effected by suitable algorithms. In this way it is possible to optimise the position of the components in the strip, which leads to a stable process with a high degree of production accuracy.

In an exemplary embodiment, the thickness along the length of the strip material can be recorded in a first region and in an adjoining second region of the strip material, with the process of cutting the first sheet metal blank out of the first region taking place depending on (in other words as a function of) the measured thickness profile of the first and of the second region. This principle can be continued in a general way. Thus, the measured values of more than two blank regions of the strip material can be used for determining the cut contour of the cutting device for cutting a sheet metal blank. For example, the cut contours of successive groups of blanks, for instance of three blanks, can be determined by taking into account the measured thickness profiles of all strip regions associated with this group.

For cutting a blank out of the strip material, one or several cutting devices can be used. If several cutting devices are used, these can be arranged parallel relative to one another, i.e., side by side with reference to the strip width, and/or one behind the other, i.e., with reference to the longitudinal extension of the strip. At least a partial cut for separating a blank from the strip material can be effected by a beam. In this case, at least one of the cutting devices is provided in the form of a beam cutting device. However, it is also possible that at least one partial cut for separating a blank out of the strip material is effected mechanically by means of a punching or cutting tool with a defined blade.

According to a possible embodiment, the strip material is tensioned in the longitudinal direction of the strip material during the cutting operation. This measure ensures a high degree of positional accuracy of the strip material and thus a high degree of production accuracy of the sheet metal blank to be cut out of same.

According to an embodiment, the at least one beam cutting device can be moved along several axes, wherein it is proposed more particularly that the movement along one axis is controllable independently of the movement along another axis. In this way, it is possible to achieve accurate positioning and a high degree of production accuracy.

It is possible to provide several cutting devices for beam cutting and/or mechanical cutting of sheet metal blanks out of the strip material. In this connection several cutting devices can work simultaneously on the contour cut of the same blank, or several sheet metal blanks can be worked simultaneously by an associated cutting device.

The process can be carried out continuously, i.e., beam cutting takes place while the strip material is being moved on. In such a case, the cutting devices move together with the strip material. Alternatively, the process can also be carried out discontinuously, i.e., the strip region to be cut is moved towards the cutting device, then the forward feed is stopped, and the sheet metal blank is cut out of the strip material while the strip is stationary. After the blank has been cut out, the strip material is moved forward for the purpose of producing the next blank. The latter method is particularly suitable for mechanical cutting operations.

According to a possible embodiment, beam cutting can be carried out in such a way that a beam-cut blank initially remains connected to the strip material by means of at least one web. Complete separation of the sheet metal blank from the remaining strip material can be carried out in a subsequent process step. For this, the at least one web is cut through by a further cutting device which follows the first cutting device in the transporting direction of the strip material. According to an embodiment, the beam cutting operation can take place such that, for the first cutting operation, a plurality of webs are provided via which the partially cut blank initially remains connected to the strip material. In this regard it is advantageous if, with reference to the forward feed of the strip, at least a first web is arranged in the front first third of the beam-cut blank, and that at least one second web, with reference to the forward feed of the strip, is arranged in the rear third of the beam-cut blank. In this way, it is possible to transmit forward feed forces from the strip material to the partially cut blank, so that the blank is positioned accurately. The first web and/or the second web can be such that, substantially, they extend in the longitudinal direction of the strip material.

According to a possible embodiment, beam cutting can be carried out with a laser beam, i.e., the beam cutting device is provided in the form of a laser beam cutting device. However, it is understood that other beam cutting devices can also be used, for instance water jet cutting. The beam cutting device is configured such that cutting parameters can be set and/or controlled during the cutting process. Such parameters influencing the cutting process, for example, are the beam power, beam focus, forward feed speed, exhaust pressures and/or other technical parameters. More particularly, it is possible that at least one of the cutting parameters of the beam cutting device is adjusted with regard to the sheet thickness and/or with regard to the material properties of the metallic material. Alternatively or additionally, said at least one of the cutting parameters can be controlled during the cutting process depending on (as a function of) the measured sheet thicknesses of the strip material. For example, thicker strip portions can be cut with different parameters than thinner strip portions, so that, overall, the cutting process can be carried out efficiently and according to requirements. Needless to say this also applies to the mechanical cutting of blanks wherein the cutting parameters influencing mechanical cutting, such as the cutting power or cutting speed, can be controlled depending on the blank thickness, i.e., as a function of the blank thickness.

Further process steps are also possible such as applying a corrosion protection to the sheet metal blanks and/or the strip material. According to a first possibility, the strip material can be coated prior to being flexibly rolled, which means however that the corrosion protection obtains different thicknesses along the length of the strip material because of the subsequent flexible rolling operation. According to a second possibility, the corrosion can also be applied after the flexible rolling operation has taken place. In this case, the thickness of the corrosion protection along the length of the flexibly rolled strip is substantially constant. In both cases, the corrosion protection can be provided in the form of a continuous operation. For this purpose, the strip material is uncoiled from the coil, then continuously provided with corrosion protection and subsequently wound up to form a coil for being brought to the respective subsequent production step. It is understood that the strip material can also be processed directly, i.e., in the unwound condition. According to a further possibility, the sheet metal blanks can also first be worked out of the strip material and subsequently, piece by piece, provided with corrosion protection.

During subsequent production steps the blanks can be further processed, for instance, formed into a formed part. The formed parts can be hardened. Alternatively, by way of press hardening, the blanks can be formed and hardened in one tool.

Further disclosed is a plant for producing a sheet metal blank, comprising:

a rolling unit for flexibly rolling strip made of a metallic material, in particular sheet steel, and a cutting unit for cutting individual sheet metal blanks out of the strip, wherein the strip comprises a plurality of regions positioned one behind the other out of each of which a respective sheet metal blank is to be cut, wherein the cutting unit comprises a measuring device for recording the thickness of the strip along the length of the strip, at least one cutting device for cutting the flexibly rolled strip and an electronic control unit (ECU) for controlling the cutting device on the basis of measured values recorded by the measuring device, wherein the distance between the measuring device and the cutting device is greater than double the length of the sheet metal blank to be cut of the strip. Thus, a target position for a sheet metal blank to be worked out of the strip material can be determined depending on (as a function of) a measured profile of at least two regions of the strip material positioned one behind the other.

The plant is suitable for carrying out the above process. To that extent there are achieved the same advantages, so that reference is made to the above description. It is understood that all process-related features can be transferred to said plant and, vice versa, all plant-related features can be transferred to the process. The plant makes it possible to optimise the position of the blanks to be cut out in the strip material, i.e., the position of the target contour of the blank to be cut out of the strip material can be adjusted accurately with regard to the sheet thickness profile of the strip material. The target contour of the sheet metal blank to be cut out is determined only after the sheet thickness has been measured along the length, thus achieving a high degree of production accuracy.

Preferably, the cutting device comprises at least one beam cutting device, wherein it is understood that in addition or alternatively, at least one mechanical cutting device can also be provided. According to an embodiment, it is also possible to provide a plurality of beam cutting devices. The beam cutting devices can be configured such and can be controlled by an electronic control unit such that several sheet metal blanks can be cut out of the strip material simultaneously. Alternatively or in addition, it is also possible to provide several cutting devices which cut out a blank simultaneously.

According to a further embodiment, there can be provided a forward feed arrangement for feeding the strip material. The forward feed arrangement can comprise a first feed device which is arranged in front of the cutting device, and a second feed device which is arranged behind the cutting device. The feed arrangement can be controllable such that the strip material is tensioned in the cutting region.

In a further embodiment, the cutting device and, respectively, the cutting out process can comprise the following features: the coil can be fed from a coil loading carriage, i.e., a device for the intermediate storage of the coil to a winch. The winch unwinds the coil and by suitable aids, the end portion of the coil is introduced into a straightening device and straightened as required. There can be provided a strip storage which equalises tolerances and fluctuations occurring in the production process. For this purpose, the strip storage is dimensioned such that the maximum feed lengths and the working speeds are fully covered. Between the strip storage and the measuring device there can be provided a strip calming device in which the strip material is calmed, i.e., straightened. The measuring device comprises a strip thickness measurement and a strip length measurement. The strip material is fed by a feed device which is arranged in front of the measuring device. Supply, respectively feed, takes place such that during ongoing operation length tolerances resulting from the rolling process can be compensated for. The first feed device is followed by roller path which comprises at least double the length of a blank region so as to achieve the necessary measuring length needed for sheet thickness measurements and for associating the contour position of several blanks relative to the sheet thickness profile. Thereafter, the contour positions are positioned in the strip, i.e. associated to the strip, and the position is transmitted to the cutting device. It is proposed more particularly that measurement of the thickness and the length values takes place continuously and said values are directly transferred to the control unit of the cutting device for exactly positioning and controlling the cutting tools. This means that there is a continuous control in the course of which the complete strip length is measured.

SUMMARY OF THE DRAWINGS

Example embodiments will be explained below with reference to the Figures wherein.

DETAIL DESCRIPTION

Figure 1:
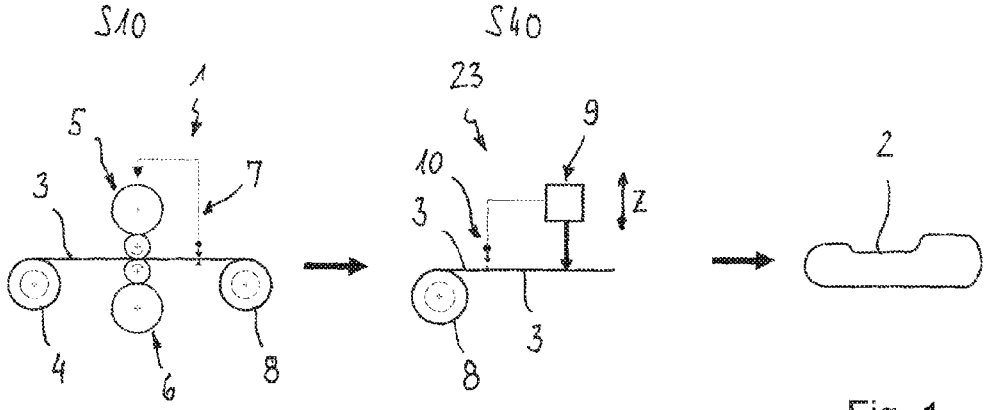
FIG. 1 shows an example process in the form of a flow diagram.

FIGS. 1 to 7 will be initially described jointly blow with regard to the features they have in common. An exemplary process as well as an exemplary plant for producing a sheet metal blank 2 out of a flexibly rolled strip material 3 is shown. The starting material can be hot strip or cold strip made of a metallic material, more particularly made of a hardenable steel material. The material can be a slit strip or a strip with a natural edge.

In process step S10, the strip material 3 is rollingly treated by a rolling unit 1, i.e., by being flexibly rolled. For this purpose, the strip material 3 which, in the starting condition, is wound up on a coil 4 and which, prior to being flexibly rolled, comprises a substantially constant sheet thickness along its length, is rolled by rolls 5, 6 such that it receives a variable sheet thickness along the rolling direction. During the rolling operation the process is monitored and controlled, with the data determined by a sheet thickness measuring device 7 being used as an input signal for controlling the rolls 5, 6. After the flexible rolling operation, the strip material 3 comprises different thicknesses along its length in the rolling direction. After the flexible rolling operation, the strip material 3 is again wound up to a coil 8, so that it can be moved to the next production step.

During a subsequent process step S40, individual sheet metal blanks 2 are cut out of the flexibly rolled strip material 3. The cutting unit 23, which can also be referred to as cutting arrangement, comprises a measuring device 10, an electronic control unit (ECU) as well as one or several cutting devices 9. The sheet metal blanks 2 are cut out of the strip material 3 in a cutting process carried out by the cutting device 9, thereby taking into account the parameters measured by the measuring device 10. The cutting device 9, more particularly, is provided in the form of a beam cutting device, wherein in this case the blank 2 being separated from the strip material by a beam 11. In one embodiment, it is possible to use a laser beam cutting device, with the blank 2 being separated from the strip material by one or several laser beams 11. However, it is to be understood that, in principle, it is also possible to use a mechanical cutting device instead of the beam cutting device.

An important sub-step in connection with cutting out the sheet metal blank 2 is measuring the thickness of the strip material 3 along its length. The measuring device 10 used for this purpose is arranged in front of the beam cutting device 9 with respect to the direction of feed of the strip material 3. The measuring device 10 comprises at least one sensor 12 for recording a value representing the thickness of the strip material 3, and a sensor 13 for recording a value presenting the length position of the strip material 3. The thickness and length values recorded by the sensors 12, 13 are transmitted to the electronic control unit (ECU). The electronic control unit serves to further process the measured thickness and length values and to control the beam cutting device 9. Measurement can take place continuously at the strip material 3 being unwound from the coil 8, wherein a respective thickness value is associated to each length position of the strip material 3, so that overall the thickness profile of the strip is recorded along the length of same. The length values and the associated thickness values are measured in the un-tensioned condition of the unwound strip material 3, i.e., apart from the required force of feed, in an essentially force-free condition.

Figure 2:
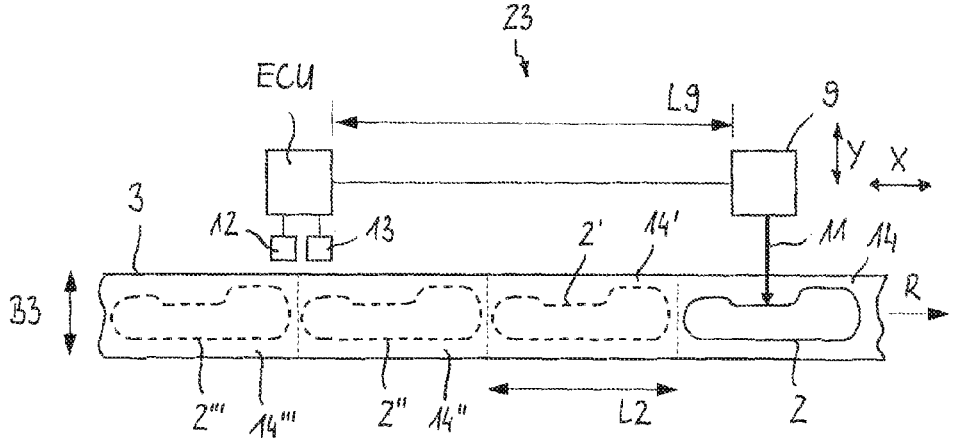
FIG. 2 shows the cutting arrangement according to FIG. 1 schematically in the form of a detail.

As can be seen in particular in FIG. 2, the distance L9 between the measuring device 10 and the beam cutting device 9 is greater than twice the length L2 of a sheet metal blank 2 to be cut out. The contours of the sheet metal blanks 2', 2", 2'" as yet to be cut out and the individual strip regions 14', 14", 14'" per sheet metal blank are shown in FIG. 2 in dashed lines. The contour of the blank 2, just being cut out is shown in a continuous line. Because of the given distance L9 between the measuring device 10 and the cutting device 9, the thickness profile of at least two strip regions 14', 14" can be recorded and taken into account for determining the contours to be cut. In this way, it is possible to compensate for length tolerances of the flexibly rolled strip material 3 and take them into account for the production of sheet metal blanks 2. In this way, production accuracy overall is improved and the rate of rejects reduced respectively.

The contour of the sheet metal blanks 2 to be cut out of the strip material 3 is arbitrary and can be set individually to suit geometric specifications. A blank 2 cut out of the strip material 3, which can also be referred to as three-dimensional blank (3D-TRB) or contour cut, is diagrammatically illustrated in FIG. 1. To cut out contours as needed, the beam cutting device 9 can be moved at least along two or more axes X, Y, Z, i.e., in the direction of fed, in the transverse direction and optionally in the vertical direction of the strip material. In this case, the beam cutting device 9 can be moved along the X axis independently of its movement along the Y axis and/or the Z axis, which analogously applies to the remaining axes (Y, Z).

To achieve a high positional accuracy of the blank 2 to be cut out, the strip material 3 can be tensioned during the beam cutting operation in the longitudinal direction L of the strip material. This can be achieved by a feeding device arranged in front of, and a feeding device arranged behind, the beam cutting device. The two feeding devices (not illustrated) are synchronised such that the strip material positioned therebetween is tensioned.

The operation of cutting the sheet metal blanks 2 out of the strip material 3 can be carried out continuously or discontinuously. In the case of the continuous cutting process, the measuring and cutting processes take place during the feeding movement of the strip material 3. In the case of a discontinuous process, the strip material 3 is fed in steps, with the blanks 2 being cut out of the strip material 3 when the strip is stationary. After one or several blanks have been cut out, the strip material 3 is moved forward for the purpose of producing the next blank(s).

Behind the last feeding device, the contour cuts and rejects can be separated by a further cutting unit, and the components can be transferred to a transport system. The transport system makes the blanks 2 available for a stacking system which stacks the blanks 2 in a customer container or on pallets.

Figure 3:
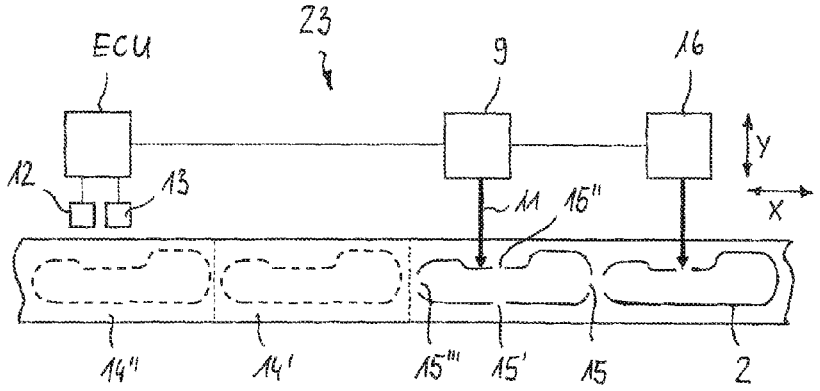
FIG. 3 shows the cutting arrangement according to FIG. 1 diagrammatically in the form of a detail in a modified embodiment.

FIG. 3 shows a cutting unit 23 for carrying out the process step S40 in a modified embodiment. This embodiment largely corresponds to the embodiment according to FIG. 2, so that as far as common features are concerned reference is made to the above description. In this regard, identical or corresponding details have been given the same reference numbers as in FIG. 2.

A difference between the embodiment according to FIG. 3 and that of FIG. 2 consists in that the cutting process takes place in two partial sub-steps. In the first cutting process, only part of the contour of the blank 2 is cut, so that the blank to be cut remains connected via several uncut webs 15, 15', 15", 15'" to the remaining edge region of the strip material 3. Complete separation of the sheet metal blank 2 from the remaining strip material 3 takes place during the subsequent second sub-step by means of a second cutting device 16. For this, the webs 15, 15', 15", 15'" are cut through by the further cutting device 16 which follows the first cutting device 9 in the transport direction L of the strip material 3. It can be seen in FIG. 3 that in the present embodiment there is provided a total of four webs, i.e. a web 15 at the front end, two side webs 15', 15" and a web 15'" at the rear end. However, it is to be understood that, per contour and size of the blank to be cut, any other technically sensible number of webs can be provided. In the condition of the second sub-step as shown, the front web 15 and the side web 15' have already been cut by the second cutting device 16.

Figure 4:
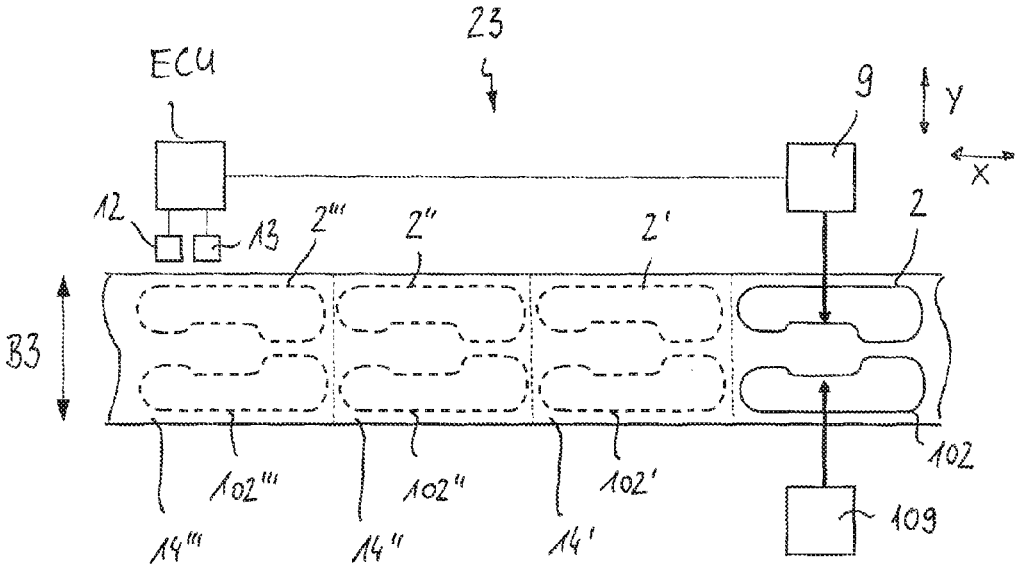
FIG. 4 shows the cutting arrangement according to FIG. 1 schematically in the form of a detail in a further embodiment.

FIG. 4 shows a cutting unit 23 for carrying out the process step S40 in a further embodiment which largely corresponds to that of the embodiment according to FIG. 2, so that, as far as common features are concerned, reference is made to the above description, with identical or corresponding details having been given the same reference numbers as in FIG. 2.

A difference between the embodiment according to FIG. 4 and that according to FIG. 2 consists in that two rows of sheet metal blanks 2, 102 are provided along the width B3 of the strip material 3 which are to be cut out of the strip material. Accordingly, there are provided two cutting devices 9, 109 which, synchronously, cut an associated blank 2, 102 out of the strip material 3. Both cutting devices 9, 109 are controlled by the electronic control unit (ECU) on the basis of the thickness of the strip material 3 recorded by the measuring device 10 along the length.

In the present embodiment it is also proposed that the respective contour position for the blanks 2, 102 to be cut out of the strip material 3 is determined depending on the measured thickness distribution along the length of at least two successive blank regions. In concrete terms it is proposed that the distance L9 between the measuring device 10 and the beam cutting devices 9, 109 is greater than three times the length L2 of a sheet metal blank 2, 102 to be cut out. In this way, when calculating the contour position of the blanks 2, 102 to be cut out, the sheet thickness distribution (sheet thickness contour) of respectively three successive blank regions 14, 14' 14", 14'" can be taken into account.

Figure 5:
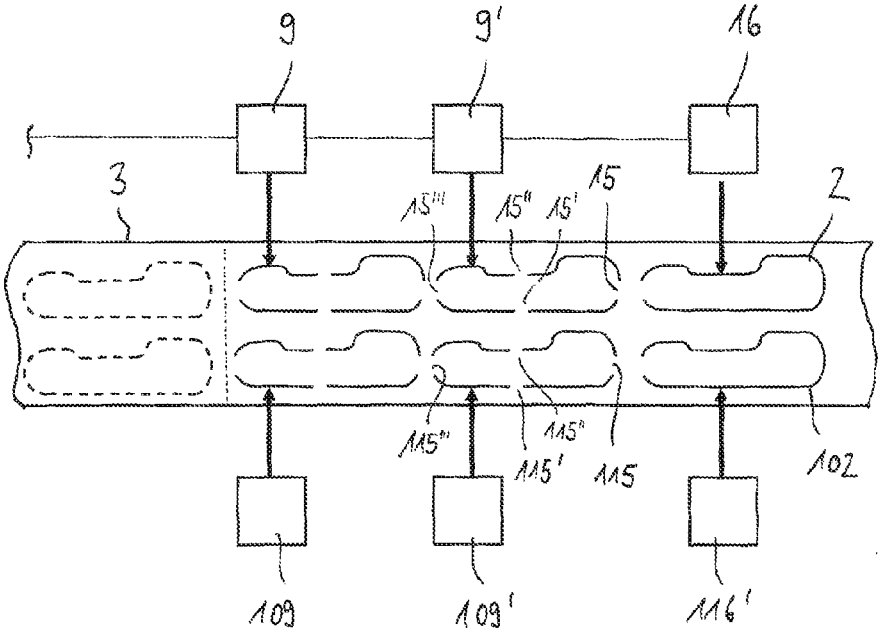
FIG. 5 shows the cutting arrangement according to FIG. 1 schematically in the form of a detail in a further embodiment.

FIG. 5 shows a cutting unit 23 for carrying out process step S40 in a further embodiment which largely corresponds to that of the embodiment according to FIG. 3, so that, as far as common features are concerned, reference is made to the above description, with identical to corresponding details having been given the same reference numbers as in FIG. 3.

A first difference concerning the embodiment according to FIG. 5 consists in that across the width B3 of the strip material 3 there are provided two rows of sheet metal blanks 2, 102 which are to be cut out of the strip material 3. Accordingly, there are also provided two cutting devices 9, 109 which, synchronously, each cut an associated sheet metal blank 2, 102 out of the strip material 3. Both cutting devices 9, 109 are controlled by the electronic control unit (ECU) on the basis of the thickness of the strip material 3 recorded by the measuring device 10 along its length. For the sake of simplicity, the measuring device is not shown in the present embodiment.

A further difference consists in that the cutting process takes place in two sub-steps. In the first sub-step of the cutting process, per row of blanks, only part of the contour of the respective blank 2, 102 is cut, so that the blank remains connected to the remaining edge region of the strip material 3 via several uncut webs 15, 115. Complete separation of the blank 2, 102 from the remaining strip material 3 takes place in the subsequent second sub-step by means of the second cutting device 16, 116. In this case, the webs 15, 115 are cut through with the further cutting device 16, 116 which follows the first cutting device 9, 109 in the transporting direction L of the strip material 3.

Furthermore, it is proposed that for carrying out the first sub-step, there are provided several cutting devices 9, 9', 109, 109' by which two successive blanks 2, 2', 102, 102' can be worked synchronously. It is thus possible to reduce the working time. For separating the webs 15, 115 in the second sub-step, it is sufficient to provide one cutting device 16, 116 for each row of blanks, because the remaining length of the webs 15, 115 to be cut is only small. The first cutting devices 9, 109; 9', 109' and the second cutting devices 16, 116 can be controlled individually by the electronic control unit.

For the present embodiment, too, it is proposed that the respective contour position for the blank 2, 102 to be cut out of the strip material 3 is determined depending on the measured thickness profile along the length of at least two successive blank regions.

Figure 6:
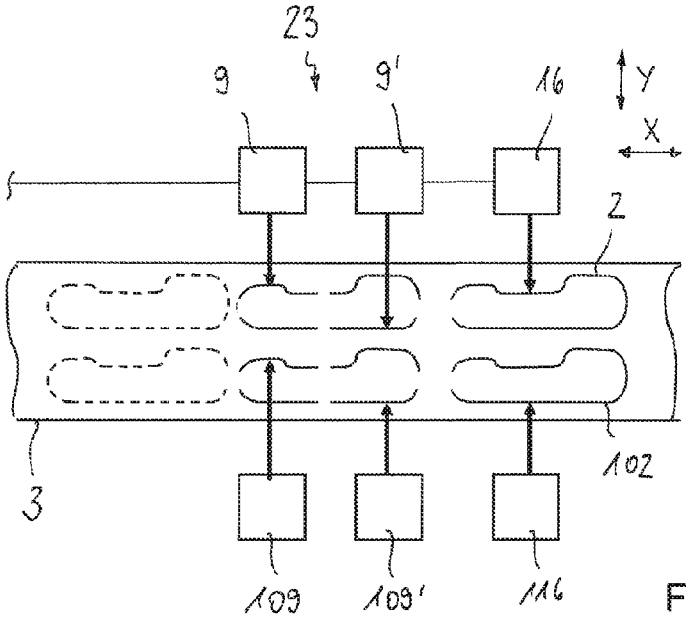
FIG. 6 shows the cutting arrangement according to FIG. 1 schematically in the form of a detail in a further embodiment.

FIG. 6 shows a cutting unit 23 for carrying out the process step S40 in a further embodiment which largely corresponds to that of the embodiment according to FIG. 5, so that, as far as common features are concerned, reference is made to the above description, with identical or corresponding details having been given the same reference numbers as in FIG. 5.

Features that the embodiment of FIG. 6 has in common with FIG. 5 are that across the width B3 of the strip material 3 there are provided two rows of sheet metal blanks 2, 102, that the cutting process takes place in two sub-steps and that the respective contour position for the sheet metal blanks 2, 102 to be cut out of the strip material 3 is determined depending on the measured thickness profile along the length of at least two consecutive blank regions 14, 14', 14", 14'".

A difference of the embodiment according to FIG. 6 is that, for carrying out the first sub-step, there are provided several cutting devices 9, 9'; 109, 109' by which respective blanks 2, 2'; 102, 102' can be worked synchronously. This also leads to a reduction in the working time relative to using only one cutting device per row of blanks. For separating the webs 15 it is provided one cutting device 16, 116 per row.

It is to be understood that further modifications are possible. For example, depending on the width B3 of the strip material 3 and the size of the blanks 2 to be cut out, it is possible to provide more than two rows. Furthermore, the blanks 2, 102 of the different rows can also be arranged so as to be offset relative to one another and/or comprise different contours.

Figure 7:
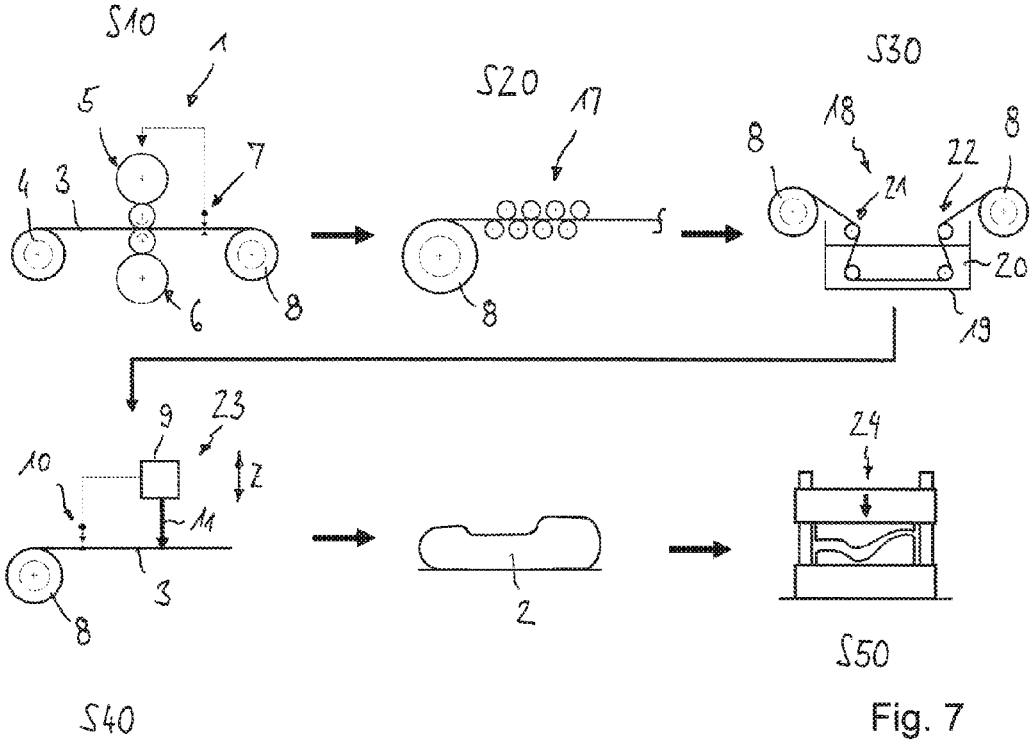
FIG. 7 shows the process according to FIG. 1 schematically in the form of a flow diagram with further process steps.

FIG. 7 shows an exemplary process with further possible process steps, which are all optional.

After the flexible rolling operation (S10), the strip material 3 can be smoothed in process step S20 by a strip straightening unit 17. If necessary, the material can be annealed after the flexible rolling and smoothing operations respectively.

After having been flexibly rolled (S10) and smoothed (S20) respectively, the strip material 3 can be provided with a corrosion protection in process step S30. For this purpose, the strip material 3 is moved through an electrolytic strip coating unit 18. It can be seen that the strip coating operation is continuous, i.e., the strip material 3 is unwound from coil 4, moves through the coating unit 18 and is again wound to a coil 4 after having been coated. The strip coating unit 18 comprises a dip tank 19 which is filled with an electrolytic liquid 20 through which the strip material 3 moves. The strip material is guided by roller sets 21, 22.

For the present process it is proposed that after having been electrolytically coated (S30), the strip material is cut in accordance with the above-described process step S40, wherein individual sheet metal blanks 2 are cut out of the strip material. It is understood that the process of cutting out the sheet metal blanks can take place in accordance with any of the embodiments according to FIGS. 2 to 6, so that in this regard reference is made to the above descriptions.

After the blanks 2 have been worked out of the strip material 3, the blank 2 can be formed into the required three-dimensional end product in the process step S50. According to a first possibility, the blanks can be hot-formed or, according to a second possibility, cold-formed.

Hot-forming can take place as a direct or indirect process. In the case of the direct process, the blanks are heated to an austenitising temperature prior to being formed, which can be effected by induction heating or heating in a furnace. After having been heated to the austenitising temperature, the heated blank is formed in a forming tool 24 whereby the component receives its end-contour and simultaneously cooled at a high cooling speed, whereby the component is simultaneously hardened. In the case of indirect hot-forming, the blank 2, prior to being austenitised undergoes a pre-forming operation. Pre-forming takes place in the cold condition of the blank, i.e., without being previously heated. While being pre-formed, the component receives a profile which does not yet correspond to the end shape, but is close to the end shape. After the pre-forming operation, as in the case of the direct process, an austenitising operation and hot-forming operation take place in the course of which the component receives its end contour.

As an alternative to hot-forming as the form-giving process, the blanks can also undergo a cold-forming process. Cold-forming is particularly suitable for soft vehicle body parts which do not have to meet special strength requirements. In the case of cold-forming, the blanks are formed at room temperature.

It is understood that the process as shown can also be modified. For example, electrolytic coating can also precede flexible rolling or it can take place by means of piece coating after the blanks 2 have been cut out of the strip material or after these have been turned into a formed part.

The invention claimed is:

1. A process of producing a sheet metal blank, comprising:

flexibly rolling a strip made of a metal-based material, wherein a thickness profile with different sheet thicknesses along the length of the strip is produced such that successive regions of the flexibly rolled strip each correspond to a target thickness profile of a sheet metal blank to be cut out of said strip;

determining a measured thickness profile for each of a plurality of said successive regions;

calculating a target position in the strip for a sheet metal blank to be cut out of the strip depending on the measured thickness profile of at least two successive regions of the strip; and cutting the flexibly rolled strip material with at least one cutting device along the target position, thereby producing the sheet metal blank.

2. A process according to claim 1, wherein determining the thickness of the strip along the length of the strip takes place continuously, wherein in each case a length position and a thickness position are associated with one another.

3. A process according to claim 1, wherein determining the measured thickness profile includes measuring the thickness of the strip along the length of the strip in a first region of the strip out of which a first sheet metal blank is to be cut, and in a second region of the strip which adjoins the first region and out of which a second sheet metal blank is to be cut, and in a third region of the strip which adjoins the second region of the strip and out of which a third sheet metal blank is to be cut; and wherein calculating the target position for the first sheet metal blank and second sheet metal blank to be cut out of the strip depends on the measured thickness profiles of at least the first region, the second region and the third region.

4. A process according to claim 1, wherein, while the strip is being cut, the strip material is pre-tensioned in a longitudinal direction.

5. A process according to claim 1, wherein the at least one cutting device is arranged to be positioned along a plurality of axes independently of one another.

6. A process according to claim 1, further comprising at least one of (a) cutting a sheet metal blank by a plurality of cutting devices, which cut the sheet metal blank simultaneously out of the strip; and (b) cutting a plurality of the sheet metal blanks out of the strip material simultaneously by at least one cutting device.

7. A process according to claim 1, wherein the cutting is effected by beam-cutting such that a beam-cut sheet metal blank initially remains connected to the strip by at least one web.

8. A process according to claim 7, wherein the cutting takes place such that a first web, with reference to the strip feeding direction, is arranged in a front first third of the beam-cut sheet metal blank, and a second web, with reference to the strip feeding direction, is arranged in a rear third of the beam-cut sheet metal blank.

9. A process according to claim 8, wherein at least one of the first web and the second web extend substantially in a longitudinal direction of the strip so that any feed forces of the strip are transmitted to the sheet metal blank.

10. A process according to claim 7, further comprising re-cutting the cut sheet metal blank, wherein the at least one web is cut through, so that the sheet metal blank is completely separated from a residual region of the strip.

11. A process according to claim 1, wherein the cutting is effected by at least one cutting beam, wherein at least one cutting parameter of the cutting beam is controlled depending on at least one of the sheet thickness and of material properties of the strip.

* * * * *